US008991077B1

(12) United States Patent
Shapiro

(10) Patent No.: US 8,991,077 B1
(45) Date of Patent: Mar. 31, 2015

(54) METHOD TO DISPLAY A FOOT ORNAMENTATION SYSTEM

(76) Inventor: Gerrie Shapiro, Bangor, ME (US)

( * ) Notice: Subject to any disclaimer, the term of this patent is extended or adjusted under 35 U.S.C. 154(b) by 496 days.

(21) Appl. No.: 13/475,062

(22) Filed: May 18, 2012

Related U.S. Application Data

(63) Continuation-in-part of application No. 12/346,275, filed on Dec. 30, 2008, now abandoned.

(60) Provisional application No. 61/058,922, filed on Jun. 5, 2008.

(51) Int. Cl.
*A43B 23/00* (2006.01)
*A43C 1/00* (2006.01)
*A43B 23/02* (2006.01)

(52) U.S. Cl.
CPC ..... *A43B 23/02* (2013.01)
USPC ..... 36/136; 36/58.5; 24/712

(58) Field of Classification Search
CPC ..... A43B 3/0078; A43B 3/00; A43B 23/02; A43B 23/24; A43B 23/25
USPC ..... 36/136, 132, 100, 101, 58.5, 58.6, 11.5; 24/712, DIG. 16; 2/245; 428/99
See application file for complete search history.

(56) References Cited

U.S. PATENT DOCUMENTS

| | | | | |
|---|---|---|---|---|
| 469,449 | A | 2/1892 | Kelley | |
| 1,196,281 | A * | 8/1916 | Quarters | 36/58.5 |
| D49,633 | S * | 9/1916 | Wellman | D26/149 |
| 1,385,328 | A | 7/1921 | Loudenslager | |
| 1,660,215 | A | 2/1928 | Ballou et al. | |
| 1,794,959 | A | 3/1931 | Howard | |
| 2,233,544 | A | 3/1941 | McKinley | |
| 3,000,119 | A | 9/1961 | Altman | |
| 4,226,036 | A * | 10/1980 | Krug | 40/633 |
| 4,461,288 | A * | 7/1984 | Curtis | 602/23 |
| 4,735,010 | A | 4/1988 | Grinarml | |
| 4,854,056 | A | 8/1989 | Levin | |
| 4,905,879 | A * | 3/1990 | Piccone | 224/173 |
| 5,092,067 | A | 3/1992 | Prout | |
| D330,342 | S | 10/1992 | Griffin | |
| 5,496,612 | A | 3/1996 | Ransbottom | |
| 6,712,286 | B2 * | 3/2004 | Baxter et al. | 239/36 |
| D508,156 | S * | 8/2005 | LaFauci et al. | D2/610 |
| 7,614,126 | B2 | 11/2009 | Gerhardt | |
| D699,404 | S * | 2/2014 | Bobka-Cradduck | D30/152 |
| 2007/0264469 | A1 | 11/2007 | Gallant et al. | |

* cited by examiner

*Primary Examiner* — Jila M Mohandesi

(57) ABSTRACT

A method to display a foot ornamentation system includes obtaining a foot ornamentation system that has a bottom band constructed from an elastomeric material for compressing the system snugly against a foot. The system has a first side panel and a second side panel that are flexible for conforming to a contour of a foot side. The system has a decorative member with an interior surface that has a smooth profile and a non-slip surface for interfacing with the foot top surface. The method includes donning the system by expanding an interior open area of the system via the stretchable bottom band then sliding over an end of a foot into a first position where the decorative member is located on a foot top surface. The method includes donning footwear with an open top that allows the system to be displayed.

7 Claims, 6 Drawing Sheets

METHOD TO DISPLAY A FOOT ORNAMENTATION SYSTEM

CROSS REFERENCE

This application claims priority to U.S. non-provisional application Ser. No. 12/346,275 filed Dec. 30, 2008 as a continuation-in-part, and U.S. provisional application Ser. No. 61/058,922 filed Jun. 5, 2008, the specification of which is incorporated herein by reference in its entirety.

BACKGROUND OF THE INVENTION

Bodily ornamentation or jewelry has been worn by humans for thousands of years and has been made from decorative items such as gemstones, precious metals, beads, or shells. Articles of clothing and more specifically, footwear have integrated ornamentation throughout the years similar to that used in jewelry as a means of style. In attempting to keep up with new styles and trends that emerge each season, a person can invest large sums of money in a versatile shoe collection. This presents issues not only of cost, but storage issues relating to acquiring a large volume of shoes. The present invention allows a person to achieve a wide variety of different styles by enabling the person to transform the style of a basic pair of shoes by using a method to display a foot ornamentation system. This application claims priority to U.S. non-provisional application Ser. No. 12/729,699 filed Mar. 23, 2010 as a continuation-in-part, the specification of which is incorporated herein by reference in its entirety.

SUMMARY

The present invention features a method to display a foot ornamentation system. In some embodiments, the method comprises obtaining a foot ornamentation system that comprises a bottom band constructed from an elastomeric material for compressing the system snugly against a foot. In some embodiments, the bottom band is stretchable for expansion to be placed around an end of a foot. In some embodiments, the bottom band is flexible for conforming to a contour of a foot bottom. In some embodiments, the bottom band comprises a low profile.

In some embodiments, the system comprises a first side panel that is flexible for conforming to a contour of a foot side. In some embodiments, the first side panel comprises a low profile. In some embodiments, the system comprises a second side panel that is flexible for conforming to a contour of a foot side. In some embodiments, the second side panel comprises a low profile.

In some embodiments, the system comprises a decorative member with an interior surface that comprises a smooth profile for contact with a foot top surface. In some embodiments, the decorative member interior surface comprises a non-slip surface for interfacing with the foot top surface.

In some embodiments, the method comprises donning the system by expanding an interior open area of the system via the stretchable bottom band then sliding over an end of a foot into a first position. In some embodiments, in the first position the decorative member is located on a foot top surface. In some embodiments, the method comprises donning footwear with an open top that allows the system to be displayed.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
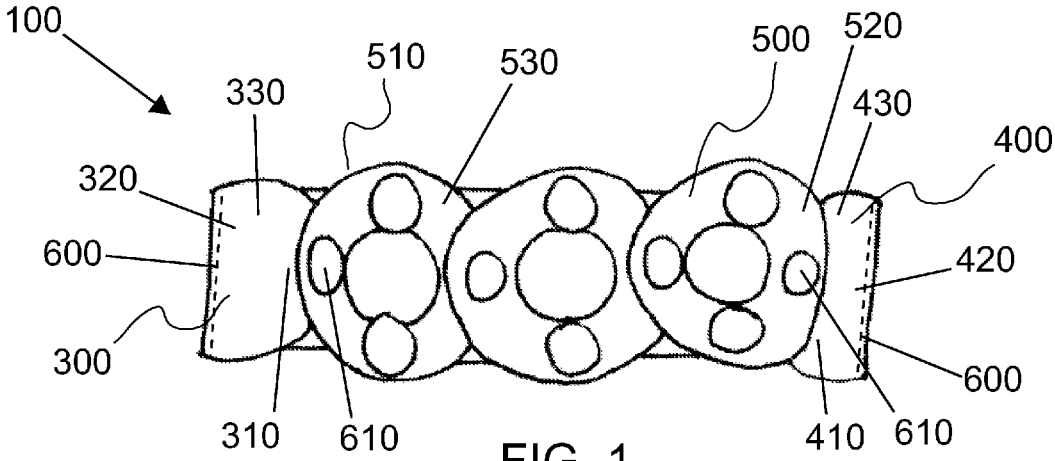
FIG. 1 is a top view of the present invention.
Figure 2:
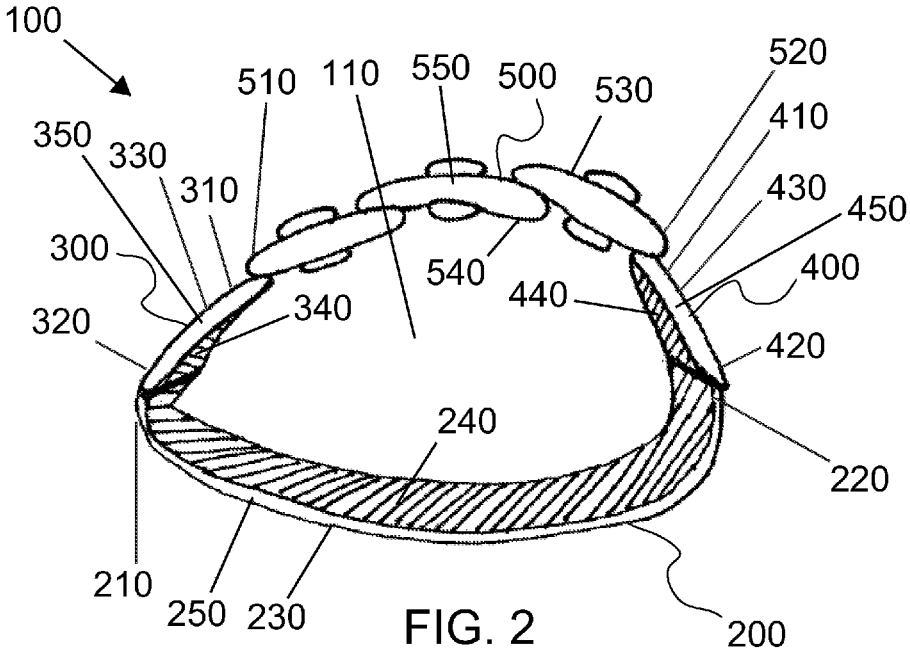
FIG. 2 is a side view of the present invention.
Figure 3:
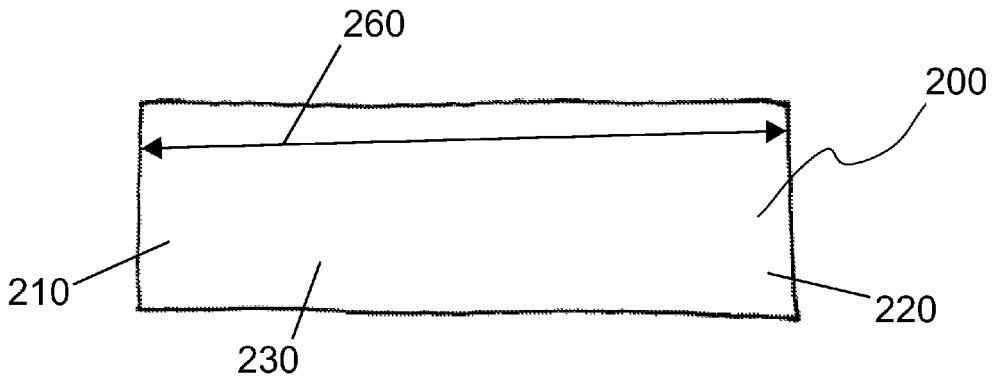
FIG. 3 is a bottom view of the present invention.
Figure 4:
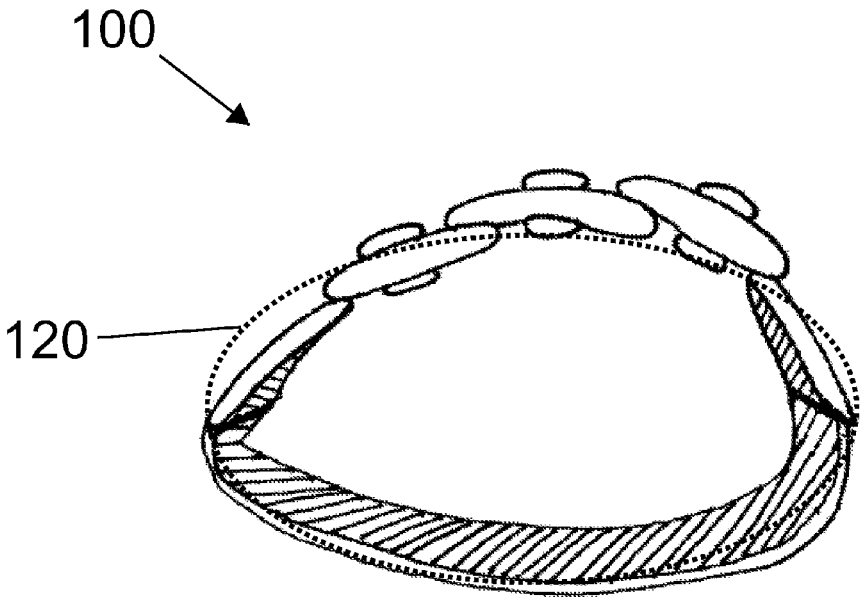
FIG. 4 is a side view of the present invention.
Figure 5:
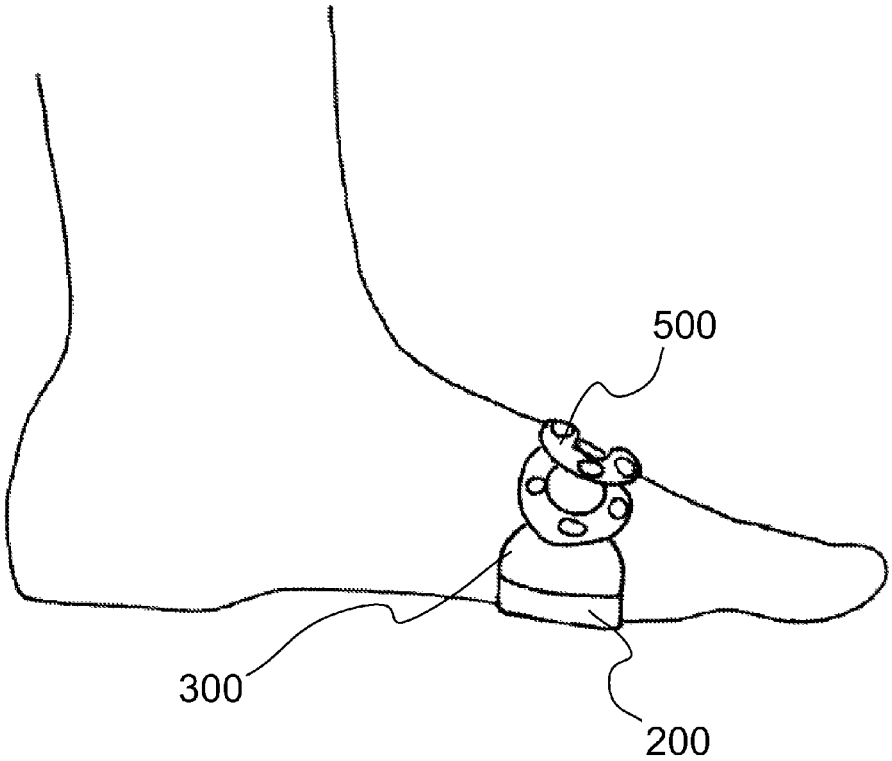
FIG. 5 is a view of the present invention worn on a foot.
Figure 6:
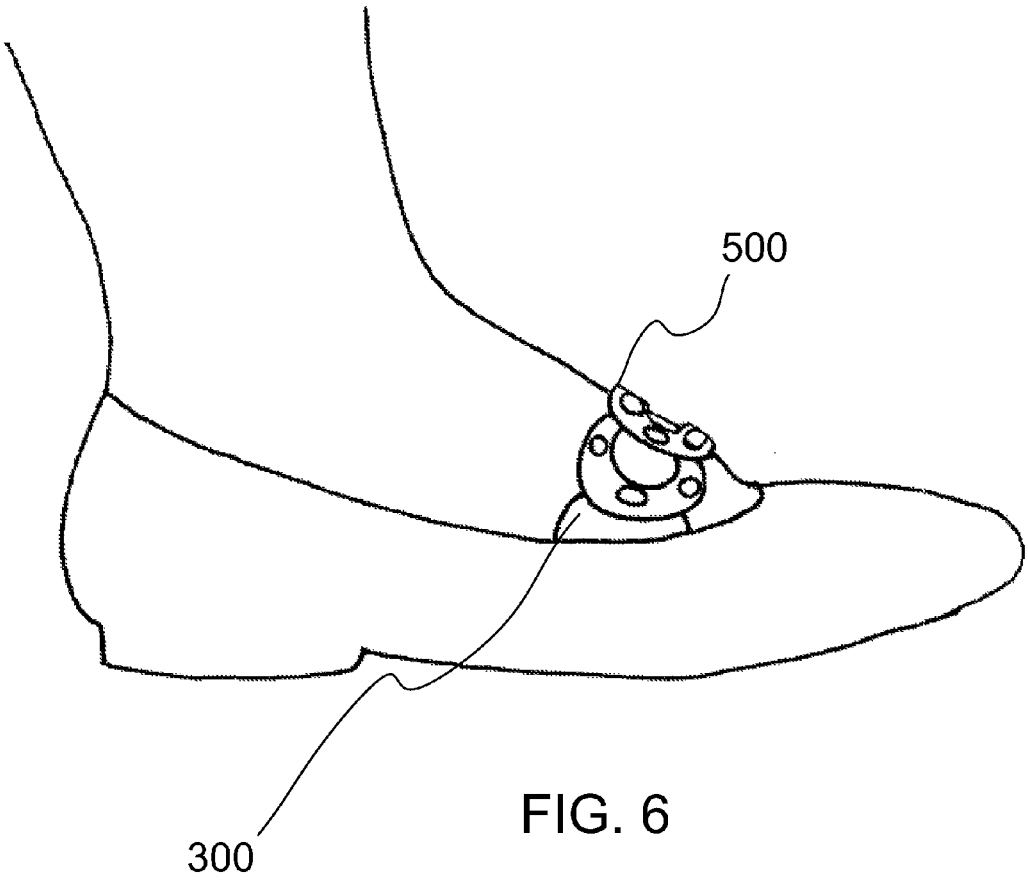
FIG. 6 is a view of the present invention worn on a foot.
Figure 7:
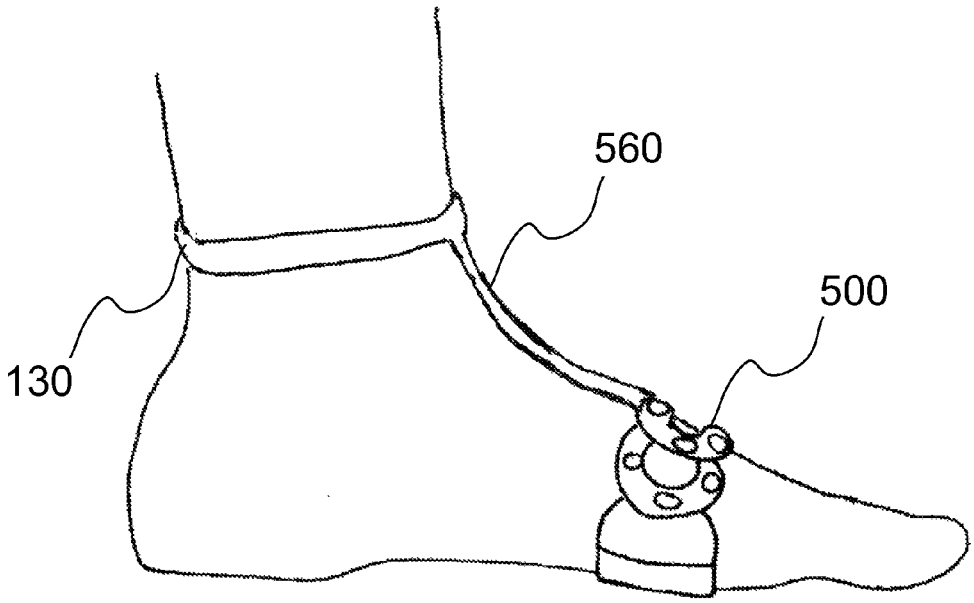
FIG. 7 is a view of an alternate embodiment of the present invention.

Following is a list of elements corresponding to a particular element referred to herein:

100 Foot ornamentation system
110 System interior open area
120 System circumference
130 Anklet
200 Bottom band
210 Bottom band first end
220 Bottom band second end
230 Bottom band exterior surface
240 Bottom band interior surface
250 Bottom band thickness
260 Bottom band length
300 First side panel
310 First side first end
320 First side second end
330 First side exterior surface
340 First side interior surface
350 First side thickness
400 Second side panel
410 Second side first end
420 Second side second end
430 Second side exterior surface
440 Second side interior surface
450 Second side thickness
500 Decorative member
510 Decorative member first end
520 Decorative member second end
530 Decorative member exterior surface
540 Decorative member interior surface
550 Decorative member thickness
560 Extension component
600 Stitching
610 Attachment component Referring now to FIG. 1-7, the present invention features a method to display a foot ornamentation system (100). In some embodiments, the method comprises obtaining a foot ornamentation system (100) that comprises a bottom band (200) having a bottom band first end (210), a bottom band second end (220), a bottom band exterior surface (230), and a bottom band interior surface (240). In some embodiments, the bottom band (200) is constructed from an elastomeric material for compressing the system (100) snugly against a foot. In some embodiments, the bottom band (200) is stretchable for expansion to be placed around an end of a foot. In some embodiments, the bottom band (200) is slid into position in a middle region of the foot posterior a ball of the foot. In some embodiments, the bottom band (200) is flexible for conforming to a contour of a foot bottom. In some embodiments, the bottom band (200) comprises a low profile.

In some embodiments, the system comprises a first side panel (300) having a first side first end (310), a first side second end (320), a first side exterior surface (330), and a first side interior surface (340). In some embodiments, the first side panel (300) is flexible for conforming to a contour of a foot side. In some embodiments, the first side panel (300) comprises a low profile.

In some embodiments, the system comprises a second side panel (400) having a second side first end (410), a second side second end (420), a second side exterior surface (430), and a second side interior surface (440). In some embodiments, the second side panel (400) is flexible for conforming to a contour of a foot side. In some embodiments, the second side panel (400) comprises a low profile.

In some embodiments, the system comprises a decorative member (500) having a decorative member first end (510), a decorative member second end (520), a decorative member exterior surface (530), and a decorative member interior surface (540). In some embodiments, the decorative member interior surface (540) comprises a smooth profile for contact with a foot top surface. In some embodiments, the decorative member interior surface (540) comprises a non-slip surface for interfacing with the foot top surface. In some embodiments, the decorative member interior surface (540) aids in maintaining placement of the system (100). In some embodiments, the decorative member interior surface (540) aids in maintaining placement of the system (100) on the foot.

In some embodiments, the bottom band first end (210) is disposed on and secured to the first side second end (320) via stitching (600). In some embodiments, the bottom band second end (220) is disposed on and secured to the second side second end (420) via stitching (600).

In some embodiments, the decorative member first end (510) is disposed on and secured to the first side first end (310) via an attachment component (610). In some embodiments, the decorative member second end (520) is disposed on and secured to the second side first end (410) via an attachment component (610).

In some embodiments, the first side panel (300) comprises a first side thickness (350) greater than a bottom band thickness (250). In some embodiments, the second side panel (400) comprises a second side thickness (450) greater than the bottom band thickness (250). In some embodiments, the decorative member (500) comprises a decorative member thickness (550) greater than the bottom band thickness (250).

In some embodiments, the method comprises donning the system (100) by expanding a system interior open area (110) via the stretchable bottom band (200) then sliding over an end of a foot into a first position. In some embodiments, the system interior open area (110) is defined by an area bordered by the bottom band (200), the first side panel (300), the second side panel (400) and the decorative member (500). In some embodiments, in the first position the decorative member (500) is located on a foot top surface.

In some embodiments, the system comprises donning footwear with an open top that allows the system (100) to be displayed.

In some embodiments, a foot ornamentation system (100) for use with an open top shoe or sandal comprises a bottom band (200) having a bottom band first end (210), a bottom band second end (220), a bottom band exterior surface (230), and a bottom band interior surface (240). In some embodiments, the bottom band (200) is constructed from an elastomeric material for compressing the system (100) snugly against a foot. In some embodiments, the bottom band (200) is stretchable for expansion to be placed around an end of a foot. In some embodiments, the bottom band (200) is flexible for conforming to a contour of a foot bottom. In some embodiments, the bottom band (200) comprises a low profile.

In some embodiments, the system comprises a first side panel (300) having a first side first end (310), a first side second end (320), a first side exterior surface (330), and a first side interior surface (340). In some embodiments, the first side panel (300) is flexible for conforming to a contour of a foot side. In some embodiments, the first side panel (300) comprises a low profile.

In some embodiments, the system comprises a second side panel (400) having a second side first end (410), a second side second end (420), a second side exterior surface (430), and a second side interior surface (440). In some embodiments, the second side panel (400) is flexible for conforming to a contour of a foot side. In some embodiments, the second side panel (400) comprises a low profile.

In some embodiments, the system comprises a decorative member (500) having a decorative member first end (510), a decorative member second end (520), a decorative member exterior surface (530), and a decorative member interior surface (540). In some embodiments, the decorative member interior surface (540) comprises a smooth profile for contact with a foot top surface. In some embodiments, the decorative member interior surface (540) comprises a non-slip surface for interfacing with the foot top surface.

In some embodiments, the bottom band first end (210) is disposed on and secured to the first side second end (320) via stitching (600). In some embodiments, the bottom band second end (220) is disposed on and secured to the second side second end (420) via stitching (600).

In some embodiments, the decorative member first end (510) is disposed on and secured to the first side first end (310) via an attachment component (610). In some embodiments, the decorative member second end (520) is disposed on and secured to the second side first end (410) via an attachment component (610).

In some embodiments, the first side panel (300) comprises a first side thickness (350) greater than a bottom band thickness (250). In some embodiments, the second side panel (400) comprises a second side thickness (450) greater than the bottom band thickness (250). In some embodiments, the decorative member (500) comprises a decorative member thickness (550) greater than the bottom band thickness (250).

In some embodiments, the attachment component (610) is a rivet. In some embodiments, the attachment component (610) is removable and replaceable. In some embodiments, the attachment component (610) is removable for removing the decorative member (500).

In some embodiments, a first decorative member (500) is removable and replaceable with a second decorative member (500).

In some embodiments, the decorative member (500) comprises an extension component (560). In some embodiments, the extension component (560) extends out and away from the decorative member (500) in a first direction toward an ankle of a wearer. In some embodiments, the extension component (560) attaches to an anklet (130) worn by the wearer around the ankle. In some embodiments, the decorative member (500), the extension component (560), and the anklet (130) comprise unitary construction.

In some embodiments, the bottom band (200) comprises a bottom band length (260) about equal to a combined length of the first side panel (300), the second side panel (400), and the decorative member (500). In some embodiments, the bottom band (200) comprises a bottom band length (260) about equal to one-half the system circumference (120). In some embodiments, the bottom band length (260) is less than one-half the system circumference (120). In some embodiments, the length of the decorative member is less than one-half the system circumference (120). In some embodiments, the length of the decorative member is greater than one-half the system circumference (120). In some embodiments, the first side panel (300), the second side panel (400), and the decorative member (500) comprise unitary construction. In some embodiments, the first side panel (300), the second side panel (400), and the decorative member (500) are a single panel.

As used herein, the term "about" refers to plus or minus 10% of the referenced number. For example, an embodiment wherein the decorative member is about 5 inches in length includes a decorative member that is between 4.5 and 5.5 inches in length.

The disclosures of the following U.S. Patents are incorporated in their entirety by reference herein: U.S. Pat. No. 469,449; U.S. Pat. No. 5,092,067;

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A method to display a foot ornamentation system (100), wherein said method comprises:

(a) obtaining a foot ornamentation system (100) that comprises:

(i) a bottom band (200) having a bottom band first end (210), a bottom band second end (220), a bottom band exterior surface (230), and a bottom band interior surface (240), wherein the bottom band (200) is constructed from an elastomeric material for compressing the system (100) snugly against a foot, wherein the bottom band (200) is stretchable for expansion to be placed around an end of a foot, wherein the bottom band (200) is flexible for conforming to a contour of a foot bottom, wherein the bottom band (200) comprises a low profile, (ii) a first side panel (300) having a first side first end (310), a first side second end (320), a first side exterior surface (330), and a first side interior surface (340), wherein the first side panel (300) is flexible for conforming to a contour of a foot side, wherein the first side panel (300) comprises a low profile, (iii) a second side panel (400) having a second side first end (410), a second side second end (420), a second side exterior surface (430), and a second side interior surface (440), wherein the second side panel (400) is flexible for conforming to a contour of a foot side, wherein the second side panel (400) comprises a low profile, and (iv) a decorative member (500) having a decorative member first end (510), a decorative member second end (520), a decorative member exterior surface (530), and a decorative member interior surface (540), wherein the decorative member interior surface (540) comprises a smooth profile for contact with a foot top surface, wherein the decorative member interior surface (540) comprises a non-slip surface for interfacing with the foot top surface;

wherein the bottom band first end (210) is disposed on and secured to the first side second end (320) via stitching (600), wherein the bottom band second end (220) is disposed on and secured to the second side second end (420) via stitching (600), wherein the decorative member first end (510) is disposed on and secured to the first side first end (310) via an attachment component (610), wherein the decorative member second end (520) is disposed on and secured to the second side first end (410) via an attachment component (610), wherein the first side panel (300) comprises a first side thickness (350) greater than a bottom band thickness (250), wherein the second side panel (400) comprises a second side thickness (450) greater than the bottom band thickness (250), wherein the decorative member (500) comprises a decorative member thickness (550) greater than the bottom band thickness (250);

(b) donning the system (100) by stretchably expanding a system interior open area (110) via the stretchable bottom band (200) then sliding over an end of a foot into a first position, wherein the system interior open area (110) is defined by an area bordered by the bottom band (200), the first side panel (300), the second side panel (400) and the decorative member (500), wherein in the first position the decorative member (500) is located on a foot top surface; and (c) donning footwear with an open top that allows the system (100) to be displayed.

2. A foot ornamentation system (100) for use with an open top shoe or sandal, wherein said system (100) comprises:

(a) a bottom band (200) having a bottom band first end (210), a bottom band second end (220), a bottom band exterior surface (230), and a bottom band interior surface (240), wherein the bottom band (200) is constructed from an elastomeric material for compressing the system (100) snugly against a foot, wherein the bottom band (200) is stretchable for expansion to be placed around an end of a foot, wherein the bottom band (200) is flexible for conforming to a contour of a foot bottom, wherein the bottom band (200) comprises a low profile;

(b) a first side panel (300) having a first side first end (310), a first side second end (320), a first side exterior surface (330), and a first side interior surface (340), wherein the first side panel (300) is flexible for conforming to a contour of a foot side, wherein the first side panel (300) comprises a low profile;

(c) a second side panel (400) having a second side first end (410), a second side second end (420), a second side exterior surface (430), and a second side interior surface (440), wherein the second side panel (400) is flexible for conforming to a contour of a foot side, wherein the second side panel (400) comprises a low profile; and (d) a decorative member (500) having a decorative member first end (510), a decorative member second end (520), a decorative member exterior surface (530), and a decorative member interior surface (540), wherein the decorative member interior surface (540) comprises a smooth profile for contact with a foot top surface, wherein the decorative member interior surface (540) comprises a non-slip surface for interfacing with the foot top surface;

wherein the bottom band first end (210) is disposed on and secured to the first side second end (320) via stitching (600), wherein the bottom band second end (220) is disposed on and secured to the second side second end (420) via stitching (600), wherein the decorative member first end (510) is disposed on and secured to the first side first end (310) via an attachment component (610), wherein the decorative member second end (520) is disposed on and secured to the second side first end (410) via an attachment component (610), wherein the first side panel (300) comprises a first side thickness (350) greater than a bottom band thickness (250), wherein the second side panel (400) comprises a second side thickness (450) greater than the bottom band thickness (250), wherein the decorative member (500) comprises a decorative member thickness (550) greater than the bottom band thickness (250).

3. The system (100) of claim 2, wherein the attachment component (610) is a rivet.

4. The system (100) of claim 2, wherein the attachment component (610) is removable and replaceable.

5. The system (100) of claim 2, wherein a first decorative member (500) is removable and replaceable with a second decorative member (500).

6. The system of claim 2, wherein the decorative member (500) comprises an extension component (560), wherein the extension component (560) extends out and away from the decorative member (500) in a first direction toward an ankle of a wearer, wherein the extension component (560) attaches to an anklet (130) worn by the wearer around the ankle.

7. The system of claim 2, wherein the bottom band (200) comprises a bottom band length (260) about equal to a combined length of the first side panel (300), the second side panel (400), and the decorative member (500), wherein the bottom band (200) comprises a bottom band length (260) about equal to one-half of a system circumference (120).

* * * * *